US006782728B2

(12) United States Patent
Latour

(10) Patent No.: US 6,782,728 B2
(45) Date of Patent: Aug. 31, 2004

(54) TUBE BENDING MACHINE

(75) Inventor: Yves Latour, Haraucourt (FR)

(73) Assignee: Ateliers de Constructions Mecaniques Latour et Fils, Bazeilles (FR)

( * ) Notice: Subject to any disclaimer, the term of this patent is extended or adjusted under 35 U.S.C. 154(b) by 0 days.

(21) Appl. No.: 10/239,260

(22) PCT Filed: Mar. 22, 2001

(86) PCT No.: PCT/FR01/00873

§ 371 (c)(1),
(2), (4) Date: Sep. 20, 2002

(87) PCT Pub. No.: WO01/70425

PCT Pub. Date: Sep. 27, 2001

(65) Prior Publication Data

US 2003/0037585 A1 Feb. 27, 2003

(30) Foreign Application Priority Data

Mar. 23, 2000 (FR) ..... 00 03706

(51) Int. Cl.[7] ..... B21D 7/024
(52) U.S. Cl. ..... 72/307; 72/217
(58) Field of Search ..... 72/217, 216, 307, 72/306, 321, 388, 387, 159, 149

(56) References Cited

U.S. PATENT DOCUMENTS 3,788,116 A 1/1974 Fazzani
4,765,168 A * 8/1988 Stange et al. ..... 72/159
4,843,858 A 7/1989 Grimm et al.
5,197,320 A * 3/1993 Saegusa ..... 72/307
6,026,668 A * 2/2000 Oda et al. ..... 72/217
6,038,903 A 3/2000 Traub

FOREIGN PATENT DOCUMENTS

| | | |
|---|---|---|
| EP | 0 209 876 | 1/1987 |
| GB | 1 298 666 | 12/1972 |
| WO | WO 87 00775 | 2/1987 |

* cited by examiner

*Primary Examiner*—Daniel C. Crane
(74) *Attorney, Agent, or Firm*—Harrison & Egbert

(57) ABSTRACT

A machine for high rate serial bending of a tube includes a bending head provided with a radius block and a backing block including, at the periphery, a groove with a semicircular cross-section and a driver for the backing block in rotation coaxial to the radius block, so as to drive the tube to be bent and wind it on the radius block. The radius block includes a disc including a beveled panel arranged along a chord of the disc and it includes device for moving the bending head relative to the axis of the tube along a path passing through the pins of the radius block and the backing block and a device for axially rotating the radius block independently from the displacement of the backing block.

4 Claims, 1 Drawing Sheet

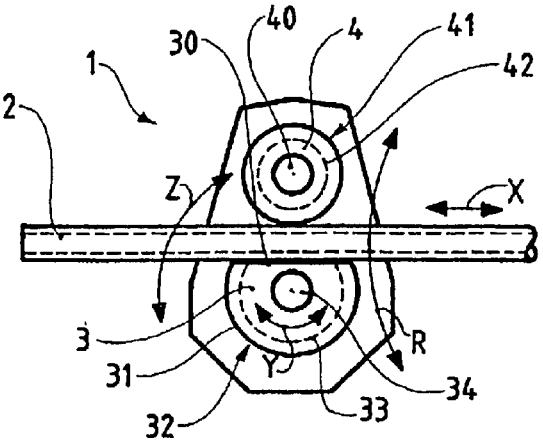
FIG. 1
FIG. 2a
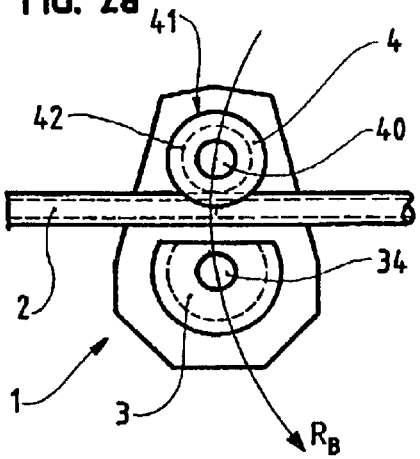
FIG. 2b
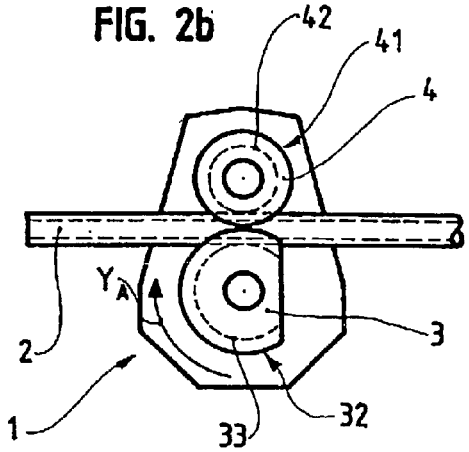
FIG. 2c
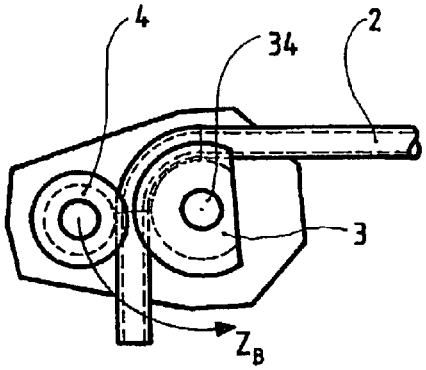
FIG. 2d
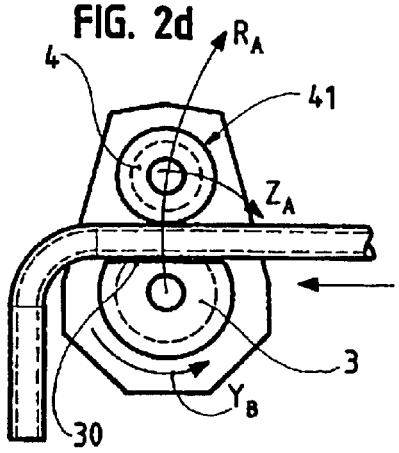

TUBE BENDING MACHINE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a machine for bending tubes in series and at a high rate.

BACKGROUND OF THE INVENTION

There are already known many devices allowing bending or curving of tubes, which consist mostly of hand tools, whether or not electrically operated, namely used by professionals of the building industry to bend copper tubes, with a view to carry out sanitary installations.

These devices include a radius block having the desired radius of curvature and a backing block capable of being moved, coaxially to said radius block, at the periphery of the latter, thus driving the tube to be bent, which is clamped between said radius block and said backing block, so as to wind it onto said radius block.

A tube cannot be curved or bent in the same ways as a wire, since, because of its axial conduit, a tube is likely to be flattened. Therefore, the radius block and the backing block each include a groove with a cross-section having the shape of an arch of a circle the radius of curvature of which corresponds to the diameter of the tube to be bent.

As a rule, the backing block is in the form of a movable block capable of pivoting to a limited extent and in which the groove is longitudinally provided for, or of a grooved rail-wheel mounted so as to be capable of freely rotating. The bending operation is performed while the tube is into contact with the bottoms of both grooves.

It should be noted that the more the grooves are surrounding, i.e. deep, with a maximum depth equal to the radius of the tube to be bent, the lesser the tube is likely to be flattened.

The tube is thus held laterally by the grooves of the radius block and the backing block, so that, in order to release it laterally from the tool, to remove it and to perform in the latter a second bending in another direction, the tool is provided with means allowing, in addition, replacing the radius block by another one with a different radius of curvature and/or suited for a tube having another diameter.

In order to allow releasing the tube, the bending devices are provided with radius blocks having a cut-off edge, in order to allow releasing the tube from the groove of the backing block. This is the case, e.g. with the machine of GB 1,298,666, which is intended for bending tubes into a U-shape by simultaneously performing two right-angle bends, each one on a backing block. It should be noted that, in order to allow releasing the tube, both backing blocks each include two cut-off edges.

It should also be noted that the machine object of that document is not intended for the same purpose as that of the present invention and that it could in no way perform the same bending operations.

The present invention indeed relates in particular to machines that allows performing the bending of tubes in series and at a high rate, these tubes namely serving for manufacturing frames. These machines include means for supplying the tube, which a bending head provided with bending tools movable with respect to each other is supplied with.

However, these machines are in particular for bending wire; hence, the bending achieved is not always of excellent quality, the tube being in most cases slightly flattened at the level of its bent portion or portions.

Furthermore, with this kind of machine, moving the radius block with respect to the backing block in order to allow releasing the tube laterally represents a loss of time, which is prejudicial for the productivity.

In addition, the use of machines of this kind is limited, since they do not allow e.g. bending a tube at 180°, then releasing it in order to remove it or to perform a bending operation in another direction.

It should also be noted that it is often necessary to perform two, or even more, bending operations in different directions on a tube, which is achieved by releasing the tube, then re-positioning it after having caused it to perform an axial rotation. With a machine as aforementioned, the axial rotation of the tube is a relative one; indeed, the bending head rotates about the axis of the tube; or, when there is no possibility for a lateral release, which would moreover be performed during a 180° bending, said rotation is impossible.

BRIEF SUMMARY OF THE INVENTION

The present invention aims at coping with the various aforementioned drawbacks by providing a tube bending machine that authorizes high working speeds and that namely allows bending the tube at 180°, without the tube being likely to be flattened.

The machine for bending a tube in series and at a high rate according to the invention includes a bending head comprising a radius block and a backing block that include, on the periphery, a groove with a semicircular cross-section, as well as means allowing driving said backing block in rotation coaxially to said radius block, so as to drive the tube to be bent and to wind it onto said radius block, and it is mainly characterized in that said radius block consists of a disc having a beveled edge arranged along a chord of said disc, and in that it includes means allowing moving said bending head with respect to the axis of the tube, along a path passing through the axes of the radius block and the backing block, as well as means for axially rotating said radius block, independently from the displacement of said backing block.

Through positioning the cut-off edge of the radius block in front of the backing block and through moving the bending head, and hence the radius block and the backing block, with respect to the axis of the tube, it is possible to release the bent tube laterally, by providing a properly sized cut-off edge, i.e. when the distance between the cut-off edge and the edge of the backing block is at least equal to the diameter of said tube.

According to an additional feature of the machine according to the invention, the means allowing moving the bending head with respect to the tube drive the latter according to a rectilinear path.

According to another additional feature of the machine according to the invention, the means allowing moving said bending head with respect to the tube drive the latter according to a curved path.

According to another additional feature of the machine according to the invention, the backing block consists of a rail-wheel.

According to another additional feature of the machine according to the invention, the backing block consists of a pressure block.

According to another additional feature of the machine according to the invention, the means allowing moving the bending head with respect to the tube and the means allowing causing the radius block to rotate axially consist of numerically controlled stepping motors.

According to a preferred embodiment of the machine according to the invention, the bending head is borne by a pivoting arm on which it is movable in rotation coaxially to the radius block, the latter being mounted so as to be movable in axial rotation about the bending head.

BRIEF DESCRIPTION OF THE SEVERAL VIEWS OF THE DRAWINGS

The advantages and features of the machine according to the invention will become more evident from the following description referring to the attached drawing, which represents a non-restrictive embodiment of it.

FIG. 1 is a partial schematic view of a tube bending machine.

FIGS. 2*a*, 2*b*, 2*c* and 2*d* are partial schematic views of the same machine, during different successive stages of a bending operation.

DETAILED DESCRIPTION OF THE INVENTION

FIG. 1 shows the bending head 1 of a machine according to the invention, on which is placed a tube 2 held by supplying means, not shown, which consists of a member capable of holding the tube 2 and of driving it axially in either direction, as shown by the double arrow X.

The bending head 1 bears a radius block 3 and a backing block 4, between which passes the tube 2.

The radius block 3 consists of a disc having a cut-off edge 30 arranged according to a chord, while its curved edge 31 includes a groove 32, only the bottom 33 of which is shown by transparency, having a semicircular cross-section with a radius equal to that of the tube 2.

The backing block 4 consists of a rail-wheel, loosely mounted on a shaft 40, which includes, at its periphery, a groove 41, only the bottom 42 of which is shown by transparency, having a semicircular cross-section, also with a radius equal to that of the tube 2.

The radius block 3 is rotationally mounted on the bending head 1, through a shaft 34 capable of being driven in rotation by driving means, not shown, so as to rotate the radius block 3 axially with respect to the bending head 1, in either direction, according to the double arrow Y.

The bending head 1 is borne by an arm, not shown, on which it can, through driving means, also not shown, pivot coaxially to the axis of rotation of the radius block 3, in either direction, according to the double arrow Z.

On the other hand, the arm, not shown, which bears the bending head 1, is movable with respect to the means for supplying the tube 2, so that it describes a path passing through the shafts 34 and 40. In the embodiment shown, this path, which is shown by the double arrow R, is curved; it results from the rotation of the arm. It should be noted that this path can preferably be rectilinear, which can however make the construction of the machine more complex.

The dimensions of the radius block 3 and the backing block 4, their center distance, as well as the height of the chord according to which the cut-off edge 30 is made are such that, when the cut-off edge 30 is in front of the backing block 4, there remains between the radius block 3 and the backing block 4 a gap at least equal to the diameter of the tube 2.

Referring now to FIGS. 2*a*, 2*b*, 2*c* and 2*d*, there can be seen various stages of a bending operation on the tube 2, whereby it should be known that FIG. 1 represents a previous stage in which the cut-off edge 30 is in front of the backing block 4 and the bending head 1 is positioned so that the tube 2 enters into contact with the cut-off edge 30.

For reasons of clearness, the various directions of rotation Y, Z and R will be followed by an index A or B according to whether they coincide with either the clockwise or the counter-clockwise direction.

In FIG. 2*a*, through a movement of the bending head 1 in the direction RB, the bottom 42 of the groove 41 of the backing block 4 is brought into contact with the tube 2.

The next stage, shown in FIG. 2*b*, consists in rotating the radius block 3 according to $Y_A$, so that the tube 2, which is in a clamped position in the axial direction, is inserted into the groove 32, then in clamping the radius block 3 in that position with respect to the bending head 1.

The tube 2 is thus enclosed between the radius block 3 and the backing block 4, in the grooves 32 and 41, respectively, of the latter. The grooves 32 and 41 are preferably semicircular and of a diameter equal to that of the tube 2, so that a close contact is brought about between the tube 2 and the bottoms 33 and 42 of the grooves 32 and 41, respectively.

In that case, the depth of the grooves 32 and 41 is equal to the radius of the tube 2, and the height of the chord according to which the cut-off edge 30 is made is equal to the diameter of the tube.

Referring now to FIG. 2*c*, one can see that the rotation of the bending head 1 in the direction $Z_B$ causes the backing block 4 to rotate coaxially to the radius block 3, which remains in the position adopted during the previous stage.

The displacement of the backing block 4 about the radius block 3 results into winding the tube 2 onto the latter.

The relative immobility of the radius block 3 is achieved in various ways, depending on the architecture of the bending head 1.

Thus, when the driving means driving the radius block 3 are borne by the bending head 1, the rotation in the direction $Z_B$ should be performed together with a compensating reverse rotation of the radius block 3 in the direction $Y_A$.

On the other hand, when the backing block 4 is rotationally mounted on the shaft 34 that bears the radius block 3, the latter can be held fixed during the displacement of the backing block 4.

It should be noted that, in a variant, it is possible to bend the tube 2 through immobilizing it on the radius block 3 through the backing block 4 that, in this case, cannot be a rail-wheel, but a clamping means, such as e.g. a pressure block, and through combining, on the one hand, a rotation of the bending head 1 according to $Z_B$ synchronized with a rotation according to $Y_A$ of the radius block 3 after having it previously caused to rotate according to $Y_A$ in order not to wind the tube 2 onto the cut-off edge 30 and, on the other hand, a proportional forward motion of the 2 according to X.

This variant namely allows bending a tube close to its end or close to a bend or an upsetting.

Referring now to FIG. 2*d*, one can see that, after bending the tube 2, the latter is moved axially, the backing block 4 has been restored into its starting position through a rotation in the direction $Z_A$, the radius block 3 has rotated in the direction $Y_B$, in order to restore the cut-off edge 30 into a position parallel to the tube 2, and the bending head 1 has been moved in the direction $R_A$, so that the cut-off edge 30 enters into contact with the tube 2 and that the latter comes out of the groove 41, so that the tube 2 can, after cutting, be released laterally.

I claim:

1. A machine for bending a tube comprising:

a bending head;

a radius block rotatably mounted on adjacent bending head, said radius block having a groove formed around a portion of a periphery thereof, said groove having a semi-circular cross-section, said radius block comprising a disc having a beveled edge formed along a single chord of said disc;

a backing block rotatably mounted on said bending head, said backing block having a groove formed around a periphery thereof, said groove having a semi-circular cross-section;

a driving means connected to said backing block for driving said backing block in rotation coaxially to said radius block so as to drive the tube and wind the tube onto said radius block;

a moving means connected to said bending head for moving said bending head with respect to an axis of the tube along a path passing through an axis of said radius block and an axis of said backing block so as to drive the tube along a curved path; and rotating means connected to said radius block for axially rotating said radius block independently of the driving of said backing block, said bending head being borne by a pivoting arm so as to be movable in rotation coaxially to said radius block, said radius block being mounted so as to be movable in axial rotation about said bending head.

2. The machine of claim 1, said backing block being a rail-wheel.

3. The machine of claim 1, said backing block being a pressure block.

4. The machine of claim 1, said moving means and said rotating means each being in numerically controlled stepping motor.

* * * * *